US005168822A

United States Patent [19]

Nufer et al.

[11] Patent Number: 5,168,822

[45] Date of Patent: Dec. 8, 1992

[54] METHOD OF MAKING SEWN PATTERNS WITH SEWING MACHINES

[75] Inventors: Karl Nufer, Steckborn, Switzerland; Lorenz Reber, Gaienhofen, Fed. Rep. of Germany

[73] Assignee: Fritz Gegauf Aktiengesellschaft Bernina-Nähmaschinenfabrik, Steckborn, Switzerland

[21] Appl. No.: 738,463

[22] Filed: Jul. 31, 1991

[30] Foreign Application Priority Data

Jan. 24, 1991 [CH] Switzerland ..... 00201/91

[51] Int. Cl.[5] ..... D05C 17/00

[52] U.S. Cl. ..... 112/266.1; 112/439

[58] Field of Search ..... 112/266.1, 456, 457, 112/458, 453, 454, 439, 78, 98, 275, 121.12, 103

[56] References Cited

U.S. PATENT DOCUMENTS

| | | | |
|---|---|---|---|
| 4,177,744 | 12/1979 | Wurst et al. | 112/457 |
| 4,309,950 | 1/1982 | Franklin | 112/121.12 X |
| 4,391,215 | 7/1983 | Sansone | 112/275 |
| 4,561,369 | 12/1985 | Meier | 112/266.1 |
| 4,599,959 | 7/1986 | Sano et al. | 112/458 X |
| 4,892,050 | 1/1990 | Ando et al. | 112/458 |

FOREIGN PATENT DOCUMENTS 2008634 6/1979 United Kingdom .

*Primary Examiner*—Peter Nerbun

*Attorney, Agent, or Firm*—Peter K. Kontler

[57] ABSTRACT

Elementary patterns are sewn in a sewing machine wherein the work can be fed by increments T. The making of a pattern involves repeatedly moving the work in and counter to the feed direction between starting the final needle penetration points which are spaced apart a distance nT wherein n is a whole number exceeding one. This results in the making of several continuous thread legs each having a length nT which can exceed, at least slightly, the maximum bight range of the needle and each extending all the way between the starting and final penetration points. In order to form a second elementary pattern which intersects the first pattern, the work is fed to move the needle to an intermediate penetration point, for example, midway between the starting and final penetration points, and the work is then fed to position the needle at the starting penetration point of the second pattern. One or more stay stitches are formed at the starting and/or final penetration point of each elementary pattern in order to increase the amount of thread in the pattern and to reduce the likelihood of deformation of the work under the action of tensioned thread legs.

15 Claims, 2 Drawing Sheets

METHOD OF MAKING SEWN PATTERNS WITH SEWING MACHINES

BACKGROUND OF THE INVENTION

The invention relates to a method of making sewn patterns in sewing machines, and to patterns which are obtained in accordance with the method.

U.S. Pat. No. 4,561,369 to Meier discloses a sewn pattern arrangement which is produced by a zig-zag sewing machine. Each pattern occupies a substantially square area having a length less than the maximum bight range and a width corresponding to the maximum range in the feed direction. Each pattern has sections which extend diagonally of a portion of the respective area. The patent teaches that the width of the rectangular area for each pattern be an integer fraction of the maximum bight width and proposes to have the starting needle penetration point for the making of a next-following pattern coincide with the final needle penetration point of the preceding pattern, i.e., to avoid the making of so-called jump stitches between successive elementary patterns. Each next-following pattern can be formed above, below, laterally adjacent or diagonally of the preceding pattern. The last thread leg of each elementary pattern extends the full length of a diagonal of the respective pattern. Such patterns can be assembled into large-area arrays by grouping rows of elementary patterns side by side.

As a rule, the maximum bight range of a household sewing machine is between 5 and 8 mm, and the maximum range in the feed direction is between 4 and 6 mm, depending upon the design or setting of the mechanism which includes the feed dog. Thus, if the bight range is 8 mm and the range in the feed direction is 6 mm, and assuming that the sewing of patterns in accordance with the teaching of Meier is based on bisection of the bight width, the maximum square area which is available for the making of an elementary pattern is $4\times4$ mm, and the maximum square area available upon trisection of the bight width is approximately $2.7\times2.7$ mm. This results in the making of relatively small elementary patterns which are often unacceptable for a number of reasons. In fact, even if an elementary pattern which can be obtained in accordance with the method of Meier were to extend along the entire bight width, such pattern would still be much too small for many purposes. Otherwise stated, the dimensions of elementary patterns which can be sewn in accordance with the method of Meier are limited by the bight width of the sewing machine. Another drawback of the patented method is that the appearance of certain types of elementary patterns is unsatisfactory because the patterns of a row of patterns are likely to be, and as a rule are, quite different from each other. This affects the visual effect of the arrangement of such patterns. The appearance of a group of elementary patterns which are obtained in accordance with the teaching of Meier is further likely to be adversely affected due to the fact that the patentee proposes to have the starting needle penetration point of a next-following pattern coincide with the final needle penetration point of the immediately preceding pattern. The making of several penetration points at the center of an elementary pattern (where the diagonally extending halves of the pattern cross each other) also affects the appearance of the pattern and entails a substantial reduction of the number of those (full-length) thread legs which extend all the way between the outermost points of a diagonally extending half pattern.

OBJECTS OF THE INVENTION

An object of the invention is to provide a novel and improved method of making elementary patterns and arrays of elementary patterns in a sewing machine, such as a zig-zag sewing machine.

Another object of the invention is to provide a method which constitutes an improvement over the method disclosed in U.S. Pat. No. 4,561,389.

A further object of the invention is to provide a novel and improved array of elementary patterns which can be obtained in accordance with the above outlined method.

An additional object of the invention is to provide a sewing machine which can be utilized for the practice of the above outlined method.

Still another object of the invention is to provide a method which can be practiced to sew relatively large elementary patterns and composite patterns.

A further object of the invention is to provide a method of making an elementary pattern wherein any desired number of thread legs can extend all the way between two points which are located at a maximum distance from each other.

An additional object of the invention is to provide a method which can be resorted to for the making of a practically infinite number of different elementary and/or composite sewn patterns.

Another object of the invention is to provide a novel and improved method of combining two or more elementary patterns into one or more composite patterns.

A further object of the invention is to provide a novel and improved cruciform pattern.

Another object of the invention is to provide a novel and improved star-shaped pattern.

An additional object of the invention is to provide a pattern having a length and/or a width exceeding the maximum bight range of the sewing machine which is used for the making of such pattern.

SUMMARY OF THE INVENTION

One feature of the invention resides in the provision of a method of stitching a sewn pattern with a movable needle and a thread in a sewing machine wherein the work to which the pattern is to be applied is fed by increments T and the pattern has a starting and a final needle penetration point. The method comprises the step of feeding the work in a predetermined direction by a plurality of increments between the starting and final points so that the pattern includes at least one continuous thread leg of a length nT (n is a preferably whole number exceeding one) and without penetration of the needle into the work between the starting and final points.

The method preferably further comprises the step of fixing (e.g., by one or more stay stitches) the at least one continuous thread leg adjacent at least one of the starting and final penetration points.

The method preferably further comprises the step of forming a second continuous thread leg of a length nT, including feeding the work in a second direction counter to the predetermined direction from the final to the starting penetration point without penetration of the needle into the work between the final and starting points. Such method can further comprise the step of forming a third continuous thread leg of a length nT, including feeding the work in the predetermined direction from the starting to the final point without penetration of the needle into the work between such starting and final points.

The method can also comprise the step of forming a stitch between one of the starting and final penetration points and an intermediate penetration point, leaving the needle in the work at the intermediate penetration point, turning the work about the needle at the intermediate point, and thereupon sewing a second pattern between second starting and final penetration points which are spaced apart from and flank the intermediate penetration point. Such method can comprise the additional step of automatically arresting the sewing machine in the course of the turning step. The intermediate penetration point can be located at least substantially midway between the starting and final penetration points.

The step of sewing the second pattern can include feeding the work from the intermediate point to the second starting point and thereupon feeding the work from the second starting point to the second final point to form a continuous thread leg of a length nT and without penetration of the needle into the work between the second starting and second final penetration points. Such step of making the second pattern can further include feeding the work from the second final point to the intermediate point and arresting the machine while the needle extends into the work at the intermediate penetration point.

The step of sewing the second pattern is normally carried out in such a way that it includes causing the needle to form a relatively short stitch between the intermediate penetration point and the second starting penetration point, and to thereupon make a plurality of stitches each having a length nT and each extending between the second starting and second final points. The stitches of such plurality of stitches include a last stitch or thread leg having a length nT and extending from the second starting point to the second final point. An additional pattern can be made between a third starting point which coincides with the second final point and a third final penetration point at a distance nT from the third starting point.

The number of thread legs in a pattern can be selected by hand, the same as the length of the increments T. Alternatively, the number of thread legs in a pattern can be selected by electronic controls (e.g., by the memory of a microcomputer) of the sewing machine.

The method can comprise the steps of manually or automatically arresting the needle while the needle extends through the work upon completion of the making of a thread leg, and setting the needle in motion by manually actuating a starter switch or another starter device of the sewing machine.

Another feature of the invention resides in the provision of a product of manufacture comprising a workpiece which can be sewn by the needle of a sewing machine (e.g., a sewing machine of the type disclosed in the patent to Meier), and a pattern of stitches on the workpiece. The pattern has a length corresponding to a multiple of the range T of the needle in the feed direction, and the pattern includes at least one continuous thread leg or beam having a length nT wherein n is a preferably whole number exceeding one.

The novel features which are considered as characteristic of the invention are set forth in particular in the appended claims. The improved method itself, however, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
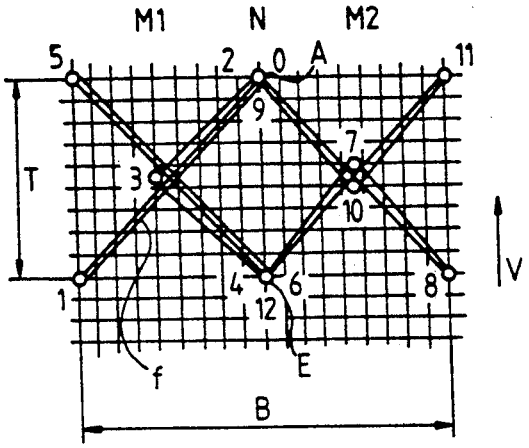
FIG. 1 PRIOR ART
FIG. 1 is a diagrammatic view of a pair of coherent conventional elementary sewn patterns.
Figure 2:
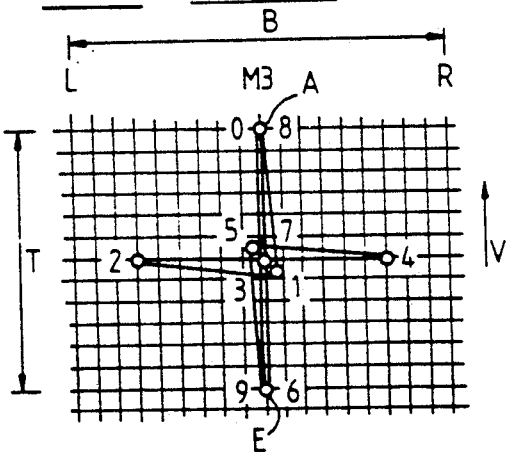
FIG. 2 PRIOR ART
FIG. 2 is a similar view of a third conventional elementary sewn pattern.
Figure 4:
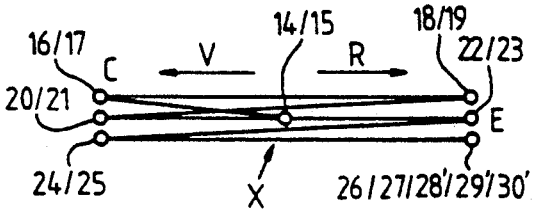
FIG. 4 is a diagrammatic view of a second novel elementary pattern which can be combined with the pattern of FIG. 3 into a composite pattern of the type shown in FIG. 9.

FIG. 1 shows two elementary sewn patterns of the type disclosed in the patent to Meier (see FIG. 13 of the reference), and FIG. 2 shows an elementary pattern corresponding to that shown in FIG. 4 of the patent to Meier. The character B denotes the maximum bight range within which the needle of the sewing machine of Meier can form a stitch, and the character T denotes the maximum range in the feed direction, i.e., the maximum length of incremental advances of the work by the feed dog of the sewing machine.

The elementary patterns M1 and M2 of FIG. 1 are based on a bisection of the bight range B, i.e., the width of the pattern M1 or M2 at most equals B/2. The single elementary pattern M3 of FIG. 2 is turned through 45° relative to the pattern M1 or M2 of FIG. 1, and the maximum length of its thread legs (such as a continuous thread leg between the starting and final penetration points A and E in FIG. 2) equals the maximum length of a (diagonal) thread leg of the pattern M1 or M2, e.g., between the needle penetration points 0 and 1 in the pattern M1. The purpose of the pattern M3 is to establish connections between rows of assembled elementary patterns (see FIGS. 15 through 18 of Meier).

When the needle which is used to sew the pattern M1, M2 or M3 of Meier is caused to assume its neutral position N, it is located midway between the ends of the bight range B. If such needle is to be used for the making of the pattern M1, it is caused to penetrate the work at the points 0, 1, 2, 3, 4, 5, 6 beginning at the starting point A (in the neutral position N of the needle) and proceeding to the final point E at 6. The thread legs f are formed in response to movements which are imparted by first and second stepping motors (51 and 70 in FIG. 1 of Meier) which respectively control the bight or stitch width of the needle and the work feed of the sewing machine. In the pattern M1 of Meier, the first two thread legs form a (diagonal) first stitch between the penetration points 0 and 1 across one half of the bight range B (the first thread leg f extends from 0 to 1 and the second thread leg f extends from 1 back to 0), the third thread leg (having a length f/2) extends from 1 to 3, and the fourth thread leg (f/2) extends from 3 to 4. Each of the third and fourth thread legs extends across one-fourth of the range B. The next two thread legs (each having a length f) are formed as a result of penetration of the needle first at 4 and then at 5 and subsequent penetration at the point 6. This completes the making of the pattern M1, and the making of the pattern M2 begins by forming a thread leg (f/2) between the points 6 and 7, i.e., the starting point of the pattern M2 coincides with the final point E of the pattern M1. The making of the pattern M2 then proceeds by forming thread legs between the points 7 and 8, 8 and 9, 9 and 10, 10 and 11, and 11 and 12 (i.e., back to the point E). In contrast to the pattern M1, the sewing of the pattern M2 necessitates the making of two penetration points 7 and 10 at the crossing point of the two diagonally extending halves of the pattern M2. The pattern M1 comprises four full-length thread legs f (two between the points 0 and 1 and two between the points 4 and 5), whereas the pattern M2 only comprises two full-length thread legs f (namely one between the points 8 and 9 and the other between the points 11 and 12). All other thread legs are shorter, i.e., they have a length f/2.

The making of the pattern M3 of Meier is analogous to the making of the pattern M1 or M2. The making begins at A and is terminated at E, and the needle is caused to penetrate into the work at the points 0 to 9 in such order. FIG. 2 shows that the sewing of the pattern M3 necessitates three penetrations of the needle at the center of the pattern. The last formed thread leg of each of the patterns M1, M2 and M3 has a length f.

A drawback of the patterns M1 to M3 is that they are very small, and the drawback of the patterns M2, M3 is that the sewing of such patterns necessitates repeated penetration of the needle at the center (i.e., at the crossing point of the thread legs f) which detracts from the appearance of such patterns. If any prong of pattern having several penetration points at the crossing of the diagonally extending halves includes more than two thread legs (note the two vertically extending prongs of the pattern M3), the intersections are plump and detract from the appearance of the respective patterns as well as from the appearance of the entire array of patterns consisting of or including patterns of the type shown in FIG. 2.

Figure 3:
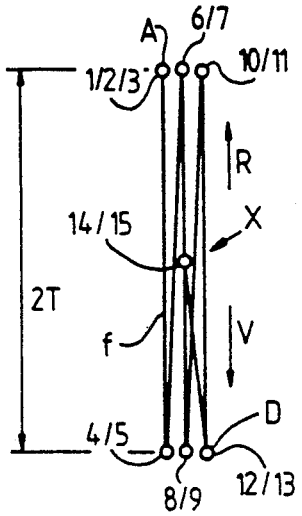
FIG. 3 is a diagrammatic view of a novel elementary sewn pattern with five full-length thread legs and a single relatively short thread leg.

The making of continuous thread legs f which are longer than the bight range and the maximum range T of the feed dog of the sewing machine in the feed direction V or R is shown in FIG. 3. In this embodiment, the maximum length of a thread leg f equals 2T, and such maximum length is achieved by avoiding the making of a perforation point (i.e., by avoiding penetration of the needle into the work) at the intermediate point X which is located at a distance T from the starting perforation point A and at the same distance T from the final perforation point D of the needle which is used to sew the elementary pattern of FIG. 3. It is equally within the purview of the invention to locate the starting and final perforation points A and D at a distance 3T, 4T, etc. from each other (i.e., at a distance nT wherein n is a whole number including three or more).

In making the sewn elementary pattern of FIG. 3, the needle is first caused to penetrate the work at the starting perforation point A. It is preferred to begin with one, two or more (e.g., three) back stitches or stay stitches at the perforation points 1, 2 and 3. The work is then fed by two increments T in the direction V without an intermediate stitch (i.e., without penetration of the needle into the work) between the starting point A and a perforation point 4 at the final point D. This results in the making of a first thread leg f having a length 2T. One or more back stitches or stay stitches are formed at 4 and/or at 5 before the direction of feed is reversed from V to R so that the thus growing elementary pattern includes two thread legs f, one between the points 3, 4 and the other between the points 5, 6. No intermediate stitch is formed between the points 5 and 6, i.e., the work is advanced by two increments T without penetration of the needle into the work. Two stay stitches are or can be formed at the points 6, 7 before the feed direction is reversed again from R to V and the work is advanced by two increments T without the making of one or more stitches between the points 7 and 8. The growing pattern then already comprises three thread legs each having a length f=2T. The procedure is repeated two more times to form two further thread legs f, the first between the points 9, 10 and the second between the points 11, 12. Two stay stitches can be formed at the points 8, 9, at the points 10, 11 and/or at the points 12, 13. The last leg of the pattern of FIG. 3 is obtained by forming a stitch between the point 13 and a point 14 at the intermediate point X, i.e., substantially or exactly midway between the starting point A and the final point D. The elementary pattern can be provided with two stay stitches at 14, 15, i.e., at the intermediate point X, and the needle is brought to a halt at the point 15 so that it can serve as a pivot or fulcrum for the work which, in accordance with one presently preferred embodiment, is turned through 90° (see FIG. 4) prior to sewing of a second elementary pattern which crosses the elementary pattern of FIG. 3 and forms therewith a substantially cruciform composite pattern of the type shown in FIG. 9. The sewing machine is preferably brought to a halt when the needle reaches the point 15 and has penetrated into the work. At such time, the finished elementary pattern of FIG. 3 includes five thread legs f each having a length 2T (without any interruptions between the ends) and a single thread leg f/2 having a length T and extending between the points 13, 14 (i.e., between the points D and X). Stoppage of the machine, with the needle extending into the work at the point 15, denotes the end of a program which is stored in the memory of the microprocessor of the sewing machine and has caused automatic formation of the elementary pattern of FIG. 3 by initiating a number of forward and reverse feed movements and penetration of the needle into the work at the points 1 to 15.

It is clear that the number of thread legs f can be reduced or increased without departing from the spirit of the invention. All that is necessary is to store a different program in the memory of the microprocessor in the sewing machine.

Turning of the work about the immobilized needle which extends into the work at the penetration point 15 can be effected by hand or automatically.

Referring to FIG. 4, the first stage of making the second pattern involves a movement of the work from the point 15 by an increment T in the feed direction V and penetration of the needle at the point 16 to form a relatively short thread leg f/2 having a length T. The machine can form two back stitches or stay stitches at 16, 17 before it proceeds to move the work counter to the feed direction V (arrow R), again in the direction V and so on in order to form a total of five consecutive thread legs f (each having a length 2T) if the pattern of FIG. 4 is to match the elementary pattern of FIG. 3 except that the two patterns are inclined relative to and cross each other at an angle of 90°. The sequence of penetrations of the needle is from the point 17 to the point 18, from the point 19 to the point 20, from the point 21 to the point 22, from the point 23 to the point 24, and from the point 25 to the point 26. The reference character C denotes the starting penetration point and the reference character E denotes the final penetration point for the needle during the making of the second elementary pattern of FIG. 4. Stay stitches can be formed at 16, 17 and/or 18, 19 and/or 20, 21 and/or 22, 23 and/or 24, 25 and/or 26, 27 (and, if necessary at the points 28', 29' and 30').

Figure 10:
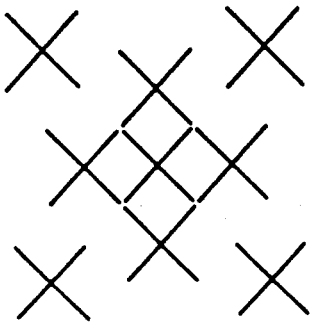
FIG. 10 shows an array of nine composite cruciform patterns of the type shown in FIG. 9.
Figure 9:
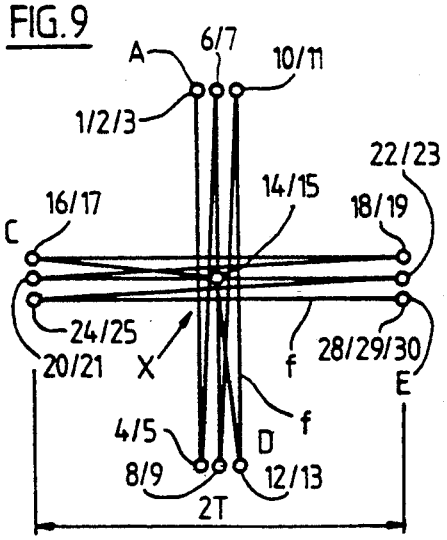
FIG. 9 is a diagrammatic view of a composite cruciform pattern including those shown in FIGS. 3 and 4 or in FIGS. 5 and 7 or in FIGS. 6 and 8.

The thus obtained cruciform composite pattern of FIG. 9 includes a total of ten thread legs f and two thread legs f/2. The elementary pattern of FIG. 4 may but need not be identical with the elementary pattern of FIG. 3. The sewing of this composite pattern begins at A, is interrupted at X to turn the work relative to its support, and continues from X to E. FIG. 10 shows that several composite cruciform patterns of the type shown in FIG. 9 can be formed next to each other to constitute an array of suitably distributed composite patterns. The array of FIG. 10 includes a set of five centrally located composite patterns of the type shown in FIG. 9 and four discrete patterns to jointly form a substantially square array. Each composite pattern of the array which is shown in FIG. 10 includes a pattern which is or can be identical with the composite pattern of FIG. 9 but is turned relative thereto through an angle of 45°. The patterns of FIGS. 5 and 7 or 6 and 8 can be combined into a composite pattern corresponding to one of the nine patterns which are shown in FIG. 10.

The elementary patterns of the nine composite cruciform patterns which are shown in FIG. 10 need not be disposed at an angle of 90° to each other. For example, one or more composite cruciform patterns can include individual patterns which cross each other at an angle of 90°, and one or more cruciform patterns of FIG. 10 can be assembled of pairs of elementary patterns making angles of, for example, 60° Furthermore, one or more composite patterns can include three elementary patterns each, and the six neighboring prongs of such patterns can make angles of 60°.

Figure 11:
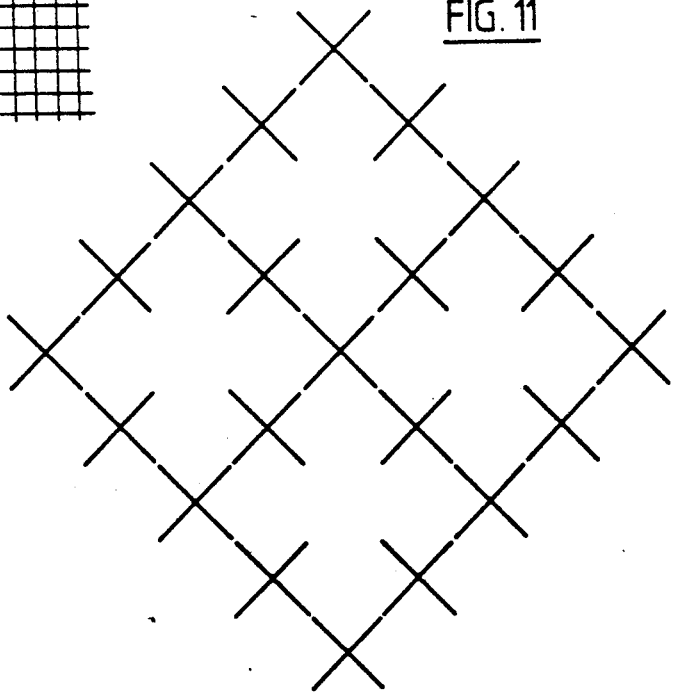
FIG. 11 shows an array of twenty-one composite patterns of the type shown in FIG. 9.

The array of FIG. 11 is obtained by sewing several rows of composite patterns of the type shown in FIG. 9. Each composite cruciform pattern of FIG. 11 can constitute a separate entity, or the starting perforation point A of one composite cruciform pattern can coincide with the final perforation point E of an adjacent composite cruciform array.

Figure 12:
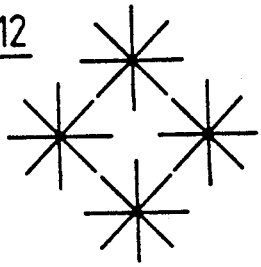
FIG. 12 shows an array of four composite star-shaped patterns each of which includes the elementary patterns of FIGS. 5 to 8 or two composite patterns of the type shown in FIG. 9.
Figure 5:
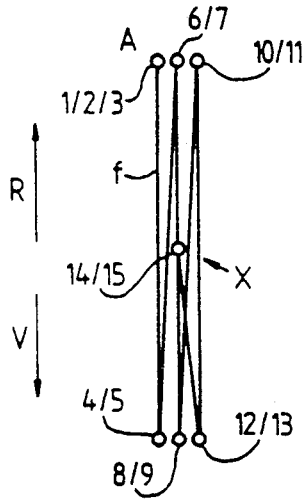
FIG. 5 is a diagrammatic view of an elementary pattern corresponding to that of FIG. 3 but sewn to be used as the first of a set of four elementary patterns jointly forming a composite pattern corresponding to one of the four composite patterns of FIG. 12.
Figure 6:
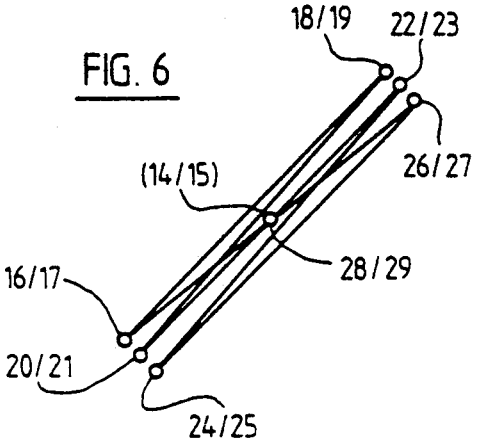
FIG. 6 is a view of the second elementary pattern of the composite pattern including that of FIG. 5.
Figure 7:
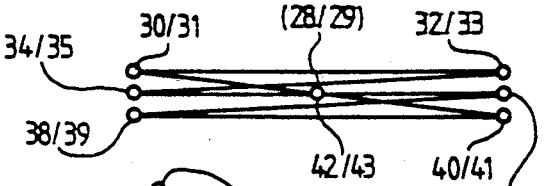
FIG. 7 is a view of the third elementary pattern of the composite pattern including those shown in FIGS. 5 and 6.
Figure 8:
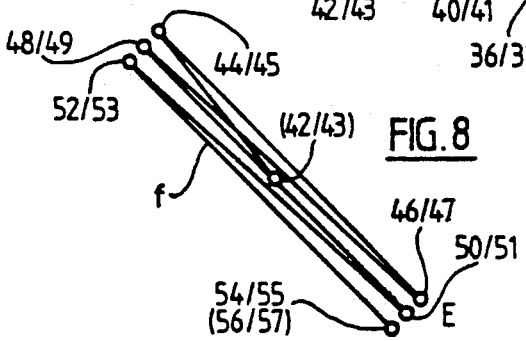
FIG. 8 is a view of a fourth elementary pattern of the composite pattern including those shown in FIGS. 5 to 7.

FIGS. 5, 6, 7, 8 and 12 show a method of sewing a star-shaped composite pattern with eight prongs which are equidistant from each other. One can start with the elementary pattern of FIG. 5 (which is identical with the pattern of FIG. 3). When the making of the pattern of FIG. 5 is completed, the needle and the sewing machine are brought to a halt while the needle extends into the work at the point 15, and the work is turned (automatically or manually) through an angle of 45° prior to sewing of the elementary pattern which is shown in FIG. 6. The elementary pattern of FIG. 4 departs from the pattern of FIG. 6 in that the latter comprises a second thread leg f/2 which extends from the point 27 to the points 28, 29. The machine is brought to a halt while the needle extends through the work at the point 29, and the work is then turned through 45° preparatory to sewing of the elementary pattern of FIG. 7. This pattern is identical with the elementary pattern of FIG. 6 in that it includes five thread legs f (between the points 30/31 and 32/33, between the points 32/33 and 34/35, between the points 34/35 and 36/37, between the points 36/37 and 38/39, and between the points 38/39 and 40/41), and two thread legs f/2 (between the points 28/29 and 30/31 and between the points 40/41 and 42/43). The machine is arrested while the needle extends through the work at the points 42/43, and the work is then turned through 45° prior to sewing of the last or fourth elementary pattern which is shown in FIG. 8. This involves the making of a single thread leg f/2 between the points 42/43 and 44/45 and thereafter the making of five thread legs f between the points 44/45 and 46/47, between the points 46/47 and 48/49, between the points 48/49 and 50/51, between the points 50/51 and 52/53 and between the points 52/53 and 54/55. The characters 56 and 57 denote the locations of stay stitches at the final perforation point E of the elementary pattern of FIG. 8 and of the composite star-shaped pattern (see FIG. 12 which shows an array of four star-shaped patterns). Thus, the completed making of the elementary pattern of FIG. 8 amounts to completion of the sewing of one of the four composite star-shaped patterns which are shown in FIG. 12.

If the array of FIG. 12 is to be assembled of a desired number of star-shaped composite patterns each of which has six (instead of eight) prongs, the making of the elementary pattern of FIG. 6 or 7 is omitted and the work is turned through angles of 60° rather than through angles of 45°. Other types of composite star-shaped patterns can be sewn in an analogous manner; all that is necessary is to store proper information in the memory or the microcomputer of the sewing machine which is used to make the patterns.

The array of FIG. 12 can also be formed by sewing eight composite patterns of the type shown in FIG. 9 and by superimposing pairs of such composite patterns at an angle of 45°.

Figure 13:
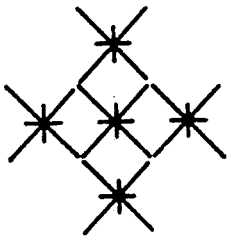
FIG. 13 shows an array of five composite star-shaped patterns constituting modifications of composite patterns which are shown in FIG. 12 or combinations of pairs of differently dimensioned composite patterns of the type shown in FIG. 9.

FIG. 13 shows a modified array of five star-shaped composite patterns in each of which shorter prongs alternate with longer prongs. The shorter prongs can be formed by reducing the maximum range T of the feed dog in the sewing machine.

The length of thread legs f as well as the number of such superimposed or neighboring thread legs in an elementary pattern is preferably determined by the person in charge of operating the sewing machine. Alternatively, the corresponding data can be stored in the memory of the sewing machine. To this end, the memory is caused to store information pertaining to the selected range T and the number of those penetrations of the needle which should not take place during advancement of the work between the starting and final penetration points of an elementary pattern. Referring again to FIG. 3, if the elementary pattern which is shown therein is made in response to signals from the microcomputer of the sewing machine rather than under manual control, the memory will store information which is necessary to avoid penetration of the needle at the point X five consecutive times and to thus form five thread legs f. It will be seen that the length of thread legs f can be determined by appropriate selection of the range T and/or by appropriate selection of the number of incremental advances of the work between two consecutive penetrations. This renders it possible to form thread legs f having a length which is not a whole multiple of the maximum possible bight range T.

An important advantage of the improved method and of the improved elementary and composite patterns is that the maximum length of thread legs is not limited to the maximum bight range and/or to the maximum range in the feed direction, i.e., nT can exceed the maximum bight range B and is a multiple of a selected range T in the feed direction. This enhances the appearance of the composite patterns and of arrays of such patterns because the majority of thread legs in each elementary pattern can have the length f, i.e., a length matching that between the starting and final penetration points A, D or C, E.

The making of stay stitches at the points A, D, C and/or E contributes to stability of the pattern and ensures the incorporation of an additional quantity of thread in the respective elementary pattern. The additional quantity of thread contributes to elasticity of the elementary pattern and reduces the likelihood of wrinkling of the work under the action of tensioned thread legs. The thread legs f of an elementary pattern can be located adjacent to or can be superimposed upon each other. Such thread legs f can be exactly or nearly parallel to one another.

The placing of the intermediate perforation point X midway between the starting and final perforation points A, D or C, E contributes to the appearance of the composite pattern because the composite pattern can be assembled of two or more symmetrically or point symmetrically arranged elementary patterns. As already mentioned above, and as shown in FIGS. 9 to 13, the elementary patterns of a composite pattern can cross each other at any desired angle, e.g., at an angle of 90° or 45°.

The making of an elementary pattern is terminated at the intermediate point X is such pattern is to be followed by an additional elementary pattern, and the making of an elementary pattern is terminated at the final penetration point E if the just finished elementary pattern is the last elementary pattern of a composite pattern consisting of two or more crossing or intersecting patterns. Termination of the making of an elementary pattern at the intermediate point X renders it possible to properly orient the thread legs of the next following elementary pattern with reference to the thread legs of the just finished elementary pattern. Moreover, turning of the work relative to its support in the sewing machine to a desired extent is simplified if the needle extends through the work at the intermediate point X while the orientation of the work is being changed.

When the sewing of the last elementary pattern of a composite pattern is completed and the needle extends through the work at the final perforation point E, the point E can but need not always (see FIG. 10) serve as the starting perforation point (A) of the first elementary pattern of a next-following composite pattern. At such time, the needle (which extends through the work at the point E) can again serve as a pivot or fulcrum to facilitate a change of orientation of the work (if such change is necessary) prior to sewing of the first elementary pattern of the next composite pattern.

A sewing machine which can be used for the practice of the improved method is disclosed in commonly owned British patent application No. 2 008 634, applied 8 Nov. 1978 owned by The Singer Company, which corresponds with U.S. application Ser. No. 852,134 of 16 Nov. 1977.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of stitching a sewn pattern with a movable needle and a thread in a sewing machine wherein the work to which an entire pattern is to be applied is fed by increments T and the entire pattern has a starting and a final needle penetration point, comprising the steps of feeding the work in a predetermined direction by a plurality of increments T between the starting and final points of the entire pattern and maintaining the needle in an upper position during the entire duration of the step of feeding the work by a plurality of increments T so that the entire pattern includes at least one continuous thread leg of a length nT and without penetration into the work between the starting and final points, n being a number exceeding one.

2. The method of claim 1, further comprising the step of fixing the at least continuous thread leg including forming at least two stay stitches adjacent at least one of the starting and final points.

3. The method of claim 1, further comprising the steps of forming a second continuous thread leg of a length nT, including feeding the work in a second direction counter to said predetermined direction from the final to the starting point, and maintaining the needle in its upper position during the entire duration of the step of forming the second continuous thread leg of length nT without penetration into the work between the final and starting points.

4. The method of claim 3, further comprising the steps of forming a third continuous thread leg of a length nT, including feeding the work in said predetermined direction from the starting to the final point, and maintaining the needle in its upper position during the entire duration of the step of forming the third continuous thread leg of a length nT without penetration into the work between the starting and the final points.

5. A method of stitching a sewn pattern with a movable needle and a thread in a sewing machine wherein the work to which the pattern is to be applied is fed by increments T and the pattern has a starting and a final needle penetration point, comprising the steps of feeding the work in a predetermined direction by a plurality of increments T between the starting and final points, maintaining the needle in an upper position during the entire duration of the step of feeding the work by a plurality of increments T so that the pattern includes at least one continuous thread leg of a length nT and without penetration into the work between the starting and final points, n being a number exceeding one, forming a stitch between one of the starting and final penetration points at an intermediate penetration point, leaving the needle in the work at the intermediate penetration point, turning the work about the needle at the intermediate point, and thereupon sewing a second pattern between second starting and final penetration points which are spaced apart from the flank the intermediate point.

6. The method of claim 5, further comprising the step of automatically arresting the machine in the course of the turning step.

7. The method of claim 5, wherein n equals two and the intermediate point is located at least substantially midway between the starting and final penetration points.

8. The method of claim 5, wherein the step of sewing the second pattern includes feeding the work from the intermediate point to the second starting point and thereupon feeding the work from the second starting point to the second final point to form a continuous thread leg of a length nT and without penetration into the work between the second starting and final points.

9. The method of claim 8, further comprising the step of feeding the work from the second final point to the intermediate point and arresting the machine while the needle extends into the work at the intermediate point.

10. The method of claim 1, further comprising the step of selecting the number of thread legs in the pattern by electronic controls of the sewing machine.

11. The method of claim 10, further comprising the step of arresting the needle while the needle extends through the work upon completion of a thread leg and setting the needle in motion by manually actuating a starter of the sewing machine.

12. The method of claim 5, wherein the step of sewing the second pattern includes causing the needle to form a stitch between the intermediate point and the second starting point and to thereupon make a plurality of stitches having a length nT and extending between said second starting and final points, said plurality of stitches including a thread leg having a length nT and extending from the second starting point to the second final point.

13. The method of claim 12, further comprising the step of making an additional pattern between a third starting point coinciding with the second final point and a third final point at a distance nT from the third starting point.

14. The method of claim 1, further comprising the step of manually selecting the number of thread legs in the pattern.

15. The method of claim 1, further comprising the step of manually selecting the length of increments T.

* * * * *